US006398606B1

(12) United States Patent
Borrelli

(10) Patent No.: US 6,398,606 B1
(45) **Date of Patent: *Jun. 4, 2002**

(54) RESCUE APPARATUS

(76) Inventor: Thomas J. Borrelli, 191 N. Union Ave., Lansdowne, PA (US) 19050

( * ) Notice: Subject to any disclaimer, the term of this patent is extended or adjusted under 35 U.S.C. 154(b) by 0 days.

This patent is subject to a terminal disclaimer.

(21) Appl. No.: 09/260,887

(22) Filed: Mar. 2, 1999

Related U.S. Application Data

(63) Continuation-in-part of application No. 08/986,442, filed on Dec. 8, 1997.

(51) Int. Cl.[7] ..... B63C 9/26

(52) U.S. Cl. ..... 441/85; 441/80; 441/82; 441/84

(58) Field of Search ..... 441/80, 82, 84, 441/85; 124/26, 27; 24/115 R

(56) References Cited

U.S. PATENT DOCUMENTS

| | | | | | |
|---|---|---|---|---|---|
| 2,765,481 | A | | 10/1956 | Manhart et al. | |
| 3,094,110 | A | | 6/1963 | Ryan | |
| 3,486,178 | A | | 12/1969 | Savage | |
| 3,496,580 | A | | 2/1970 | Gulmon et al. | |
| 3,949,731 | A | * | 4/1976 | Caso | 124/27 |
| 3,974,536 | A | * | 8/1976 | Franklin | 9/14 |
| 4,056,859 | A | * | 11/1977 | Pace | 124/27 |
| 4,077,349 | A | | 3/1978 | Paul | |
| 4,094,028 | A | | 6/1978 | Fujiyama et al. | |
| 4,505,179 | A | | 3/1985 | Nelson | |
| 4,541,402 | A | | 9/1985 | Winters | |
| 4,644,930 | A | | 2/1987 | Mainhardt | |
| 4,661,077 | A | | 4/1987 | Griffith et al. | |
| 4,778,424 | A | | 10/1988 | Lloyd | |
| 4,799,906 | A | | 1/1989 | Perkins, Jr. | |
| 4,827,894 | A | | 5/1989 | Schallberger | |
| 4,944,242 | A | | 7/1990 | Russell | |
| 5,025,771 | A | | 6/1991 | Hanson | |
| 5,409,187 | A | | 4/1995 | Dunham | |
| 5,447,144 | A | * | 9/1995 | Ivy | 124/26 |
| 5,546,863 | A | | 8/1996 | Joslyn | |
| 5,584,736 | A | | 12/1996 | Salvemini | |
| 5,895,300 | A | * | 4/1999 | Borrelli | 441/85 |

* cited by examiner

*Primary Examiner*—S. Joseph Morano
*Assistant Examiner*—Lars A. Olson
(74) *Attorney, Agent, or Firm*—Klehr, Harrison, Harvey, Branzburg & Ellers; John F. Letchford

(57) ABSTRACT

A water or land rescue system is provided which includes a spring loaded firearm and rescue device. The firearm includes a barrel, a shoulder stock and a trigger. The rescue device is adapted to be releasably secured to one end of the spring situated within the firearm. The system further includes a supply of safety line having one end secured to the firearm and a second end secured to the rescue device. The spring is adapted to be releasably locked in a loaded position so that when the trigger is depressed, the restoring forces of the spring cause the rescue device to be propelled into the air carrying the supply line therewith toward a rescue victim.

12 Claims, 4 Drawing Sheets

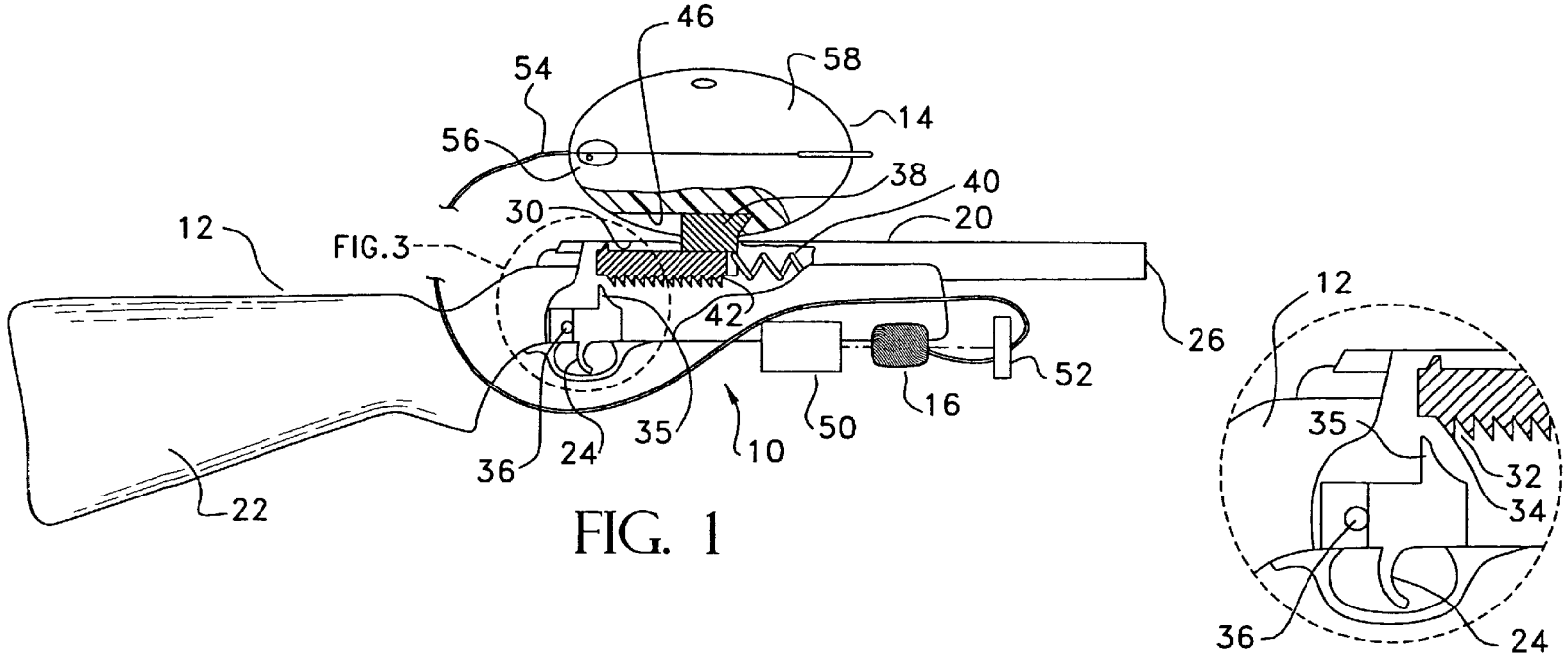
FIG. 1
FIG. 3
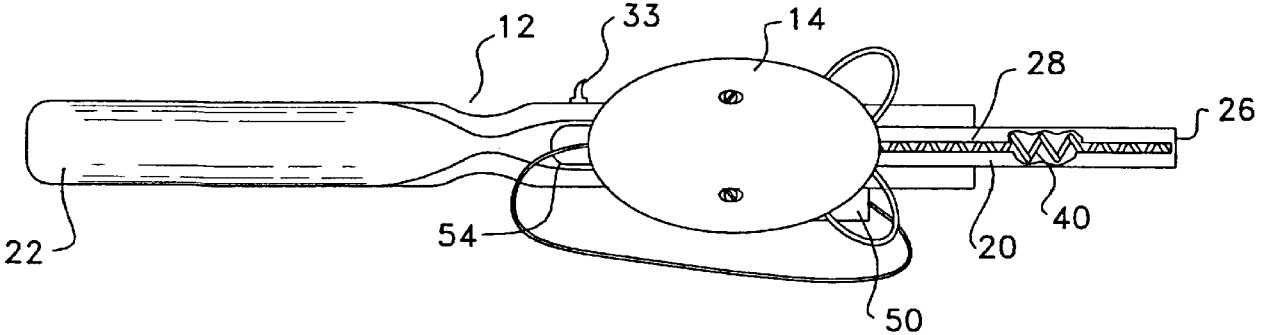
FIG. 2

RESCUE APPARATUS

CROSS-REFERENCE TO RELATED APPLICATIONS

The present application is a continuation-in-part of pending application Ser. No. 08/986,442 filed Dec. 8, 1997, entitled WATER RESCUE DEVICE.

FIELD OF THE INVENTION

This invention relates to rescue apparatus and, more particularly, to apparatus which is adapted to launch a rescue device, which has a life line secured to one end thereof, to a person in distress who is located a substantial distance from the site of the deployment.

BACKGROUND OF THE INVENTION

One of the most dangerous of all emergency rescues is the ice water rescue. This type of rescue typically places both the rescuer and victim in danger.

An existing method of rescuing a person who has fallen into a frozen body of water is to throw a rope or safety line, which preferably has a buoyant rescue device secured to one end, to the distressed person. This method has several drawbacks associated therewith. For example, a significant amount of time is wasted as the rescuer attempts to accurately throw the rope to the distressed person. A further problem is that the person who has fallen into the ice water quickly begins to suffer the effects of hypothermia and may have trouble maintaining a grip on the rope or line that has been thrown to him or her.

Another existing method utilized to save a person who has fallen into a frozen body of water involves positioning one or more ladders on the ice so that a rescuer can crawl across the frozen body of water and reach the distressed person. This method is commonly used by members of the fire department. A disadvantage associated with this method is that it is rather dangerous since the ice could unexpectedly crack thereby causing the rescuer to fall into the same frozen body of water as the person he or she is attempting to rescue.

In recognition of the drawbacks associated with prior rescue methods, devices have been developed which are designed to propel a life line to a drowning victim located a substantial distance from the launching site so that the rescuer can pull the victim to safety without the rescuer encountering any risk. See, for example, U.S. Pat. Nos. 3,486,178, 3,496,580, 4,644,930, 4,799,906, 5,546,863, and 5,584,736. These patents disclose various gun firing devices which can launch a floatation device through the air.

However, none of the devices disclosed in these patents includes means associated with the rescue device to securely and reliably lock the device to the victim. Such locking means are especially important in instances where the temperature of the water into which the victim has fallen is under 60° F. since hypothermia may set in and the victim may not be able to hold onto the device for the time required to pull him or her to safety. Similar problems may also be encountered in land rescues. For example, a small child or a weakened and/or injured adult may be trapped in a well or crevasse or on a ledge or ski slope and may not possess the strength to maintain a grasp on the rescue device as the victim is lifted from danger.

Further, the devices disclosed in the above-referenced patents do not include means for readily mounting the device to the launching gun. Such devices also typically require replacement parts after repeated use.

U.S. Pat. No. 4,661,077 discloses a lifesaving and mooring device which seeks to overcome the problems associated with securely tethering aquatic rescue victims. The device comprises a resilient, floatable member defining a pair of channels therethrough, which channels are adapted for slidable receipt of a flexible, elongated member such as a rope. The rope slidably passes through the channels in a U-like configuration so as to form an adjustable slip-loop. At least one end of the loop is knotted to resist removal of the rope from the channels.

In operation, the device is thrown toward the victim who then grabs the device, expands the slip-loop, if necessary, and inserts the desired body part within the slip-loop. The rescuer then draws the slip-loop tightly about the victim's selected body part and pulls the victim to safety.

Such a construction is disadvantageous or several reasons. For instance, the exposed knot may come untied because of jostling of the rope or tampering by vandals. Moreover, exposure of the knot to rain, snow, ice and ultraviolet radiation may degrade the rope material in the vicinity of the knot such that the rope may experience shear failure when the knot is drawn tightly against the device during a rescue operation. In addition, the presence of multiple channels through which the rescue rope must slide increases the likelihood of malfunction of the device under rescue conditions. More specifically, the potential for clogging of the channels with dirt and debris which might result in jamming of the slip-loop increases with the number of channels provided in the device.

SUMMARY OF THE INVENTION

The present invention is designed to overcome the deficiencies of the prior art discussed above. It is an object of the present invention to provide a rescue apparatus suitable for aquatic and non-aquatic rescue situations which is adapted to securely engage one or more body parts of a person in distress.

It is a further object of the invention to provide such a device which is relatively easy and inexpensive to manufacture.

It is yet another object of the invention to provide a rescue apparatus that can be used repeatedly without requiring replacement parts.

In accordance with the illustrative embodiments, demonstrating features and advantages of the present invention, there is provided a rescue apparatus which includes a spring loaded firearm and a rescue device capable of being launched by the firearm toward a victim. The firearm includes a barrel, a shoulder stock and a trigger. Situated within the barrel is a spring. A supply of safety line has one end secured to the spring loaded firearm and a second end secured to the rescue device. The spring is adapted to be releasably locked in a stressed or loaded position so that when the trigger is depressed, the restoring forces of the spring cause the rescue device to be propelled into the air carrying the safety line therewith.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent for the following description of preferred embodiments thereof shown, by way of example only, in the accompanying drawings, wherein:

FIG. 1 is a side elevation view, in partial section, of a first embodiment of a rescue apparatus according to the present invention with a supply of safety line shown displaced from its container;

FIG. 2 is a top plan view of the rescue apparatus of FIG. 1;

FIG. 3 is an enlarged plan view of the trigger mechanism encircled in FIG. 1;

DETAILED DESCRIPTION OF THE INVENTION

Figure 4:
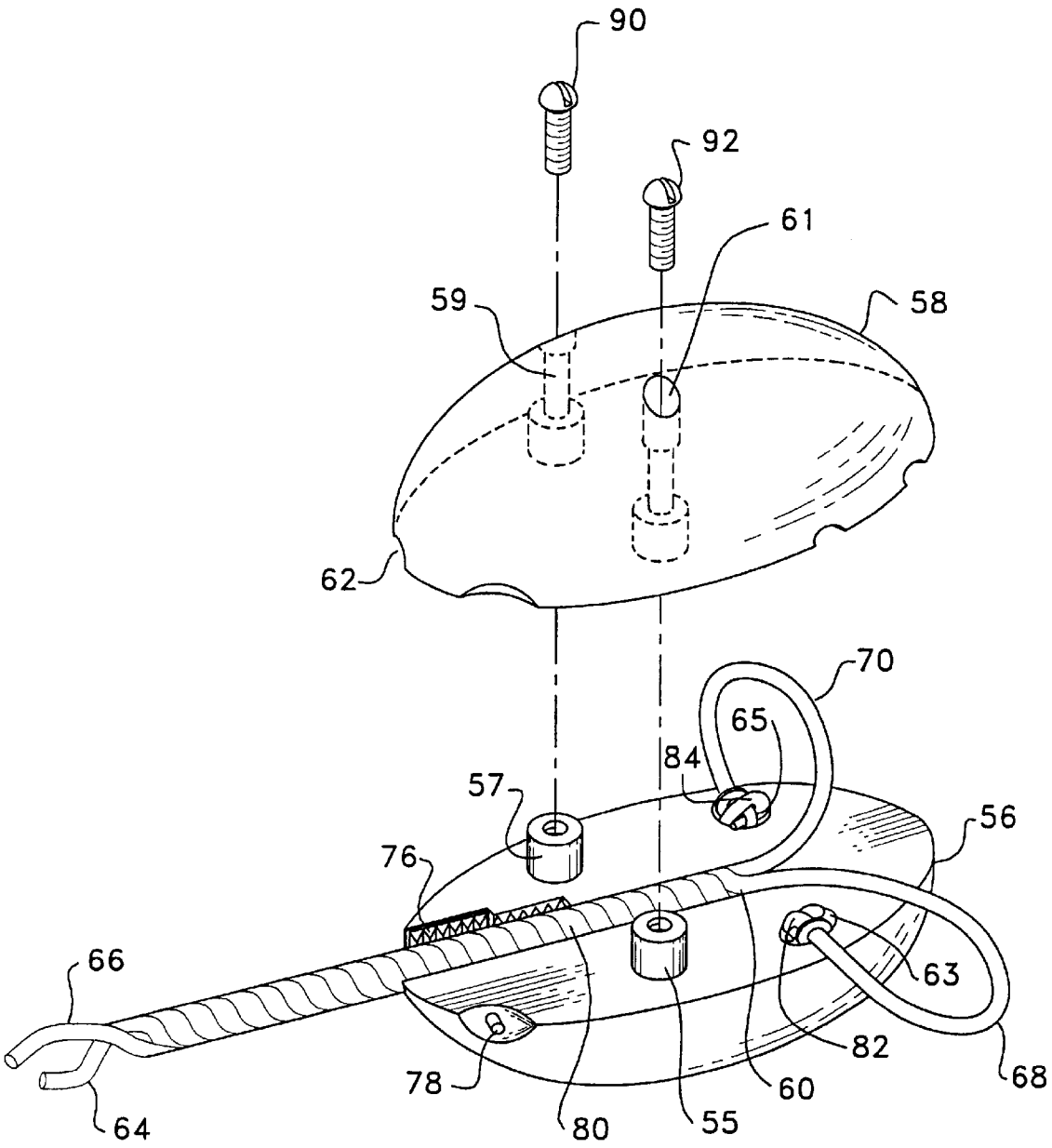
FIG. 4 is an exploded perspective view of a first embodiment of a rescue vice according to present invention.

Referring now to the drawings in detail wherein like references indicate like or similar elements throughout the several views, there is shown in FIGS. 1 and 2 a rescue apparatus suitable for water and land rescue operations constructed in accordance with a first preferred embodiment of the present invention and designated generally by reference numeral 10.

Rescue apparatus 10 preferably comprises a spring loaded firearm 12, rescue device 14 which is desirably aerodynamic and adapted to be launched through the air, and a supply of suitable safety line 16 which has one end secured to the firearm 12 and an opposite end secured to the rescue device 14. In the event rescue apparatus 10 is to be used in a water rescue operation, rescue device 14 is desirably a floatation device fabricated from suitable buoyant materials such as foamed or hollow plastics, rubber, or the like.

Firearm 12 includes a barrel 20, a shoulder stock 22 and a trigger 24. The barrel 20 includes a muzzle 26 and preferably has an elongated groove or slot 28 formed along the length thereof (FIG. 2). A ratchet 30 is mounted for axial movement along the length of the barrel 20 of the firearm 12. The ratchet 20 includes a plurality of notches and a plurality of teeth shown by way of example at 32 and 34, respectively, in FIG. 3. Each of the notches 32 in the ratchet 30 is situated between two adjacent teeth 34. As seen in FIG. 2, a gripping member 33 is connected to ratchet 30 and extends laterally outwardly from the firearm 12 through an unillustrated elongated groove formed in the side thereof.

A pawl 35 (FIGS. 1 and 5) is connected to trigger 24 and is adapted to extend into one of the notches 32 and engage one of the teeth 34. The trigger 24 and associated pawl 35 are mounted for pivotal movement about pin 36 as more fully described below.

Figure 5:
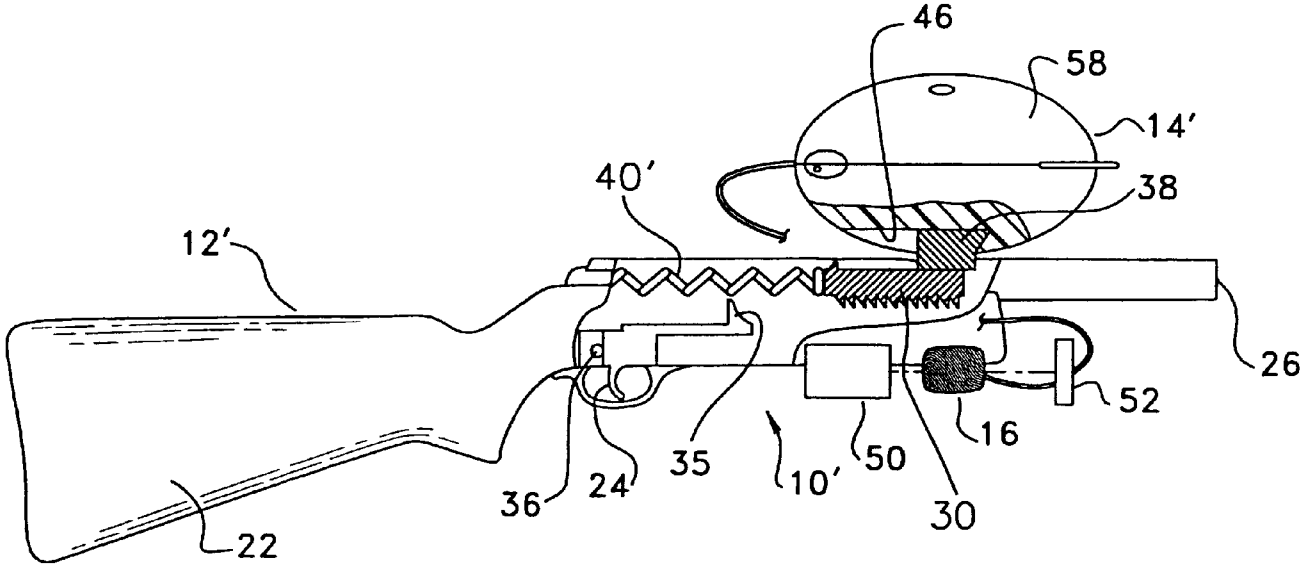
FIG. 5 is a view a similar to FIG. 1 of a further embodiment of a rescue apparatus according to the invention.

Extending upwardly from the ratchet and through the groove or slot 28 in the barrel 20 of the firearm 12 is a rescue device engaging segment 38 which is configured to releasably engage a corresponding recess 46 provided in rescue device 14 of FIG. 1 and rescue device of 14' of FIG. 5. According to a first preferred embodiment of apparatus 10, situated within the barrel 20 is a tension spring 40 which has one end secured adjacent the muzzle 26 and an opposite end 42 secured proximate to the rescue device engaging segment 38.

In the preferred embodiment, a container 50, which includes a removable lid 52, is mounted to the firearm 12 as shown in FIG. 1. The supply of safety line 16 is preferably disposed within the container. The supply of line is desirably passed through an opening in the lid 52 of the container 50 and the distal end 54 of the supply of line 16 is secured to the rescue device 14.

Referring to FIG. 4, a first preferred aerodynamic rescue device 14 is shown which comprises a body preferably including first and second half segments 56 and 58, respectively. Each half segment includes a planar surface and an accurate surface. The segments are adapted to mate with one another to preferably form a generally football-shaped rescue device. Each of the half segments is preferably comprised of a rigid polymeric material and includes a generally Y-shaped channel 60 and 62, respectively, formed in the planar surface thereof. Half segment 56 includes a pair of opposed recessed portions 63 and 65 formed therein. Similarly, half segment 58 includes a pair of opposed recessed portions formed therein.

Further, half segment 56 preferably includes two projections 55 and 57 extending outwardly from the planar surface thereof. Each of the projections includes a threaded opening formed therein. Half segment 58 includes two screw holes 59 and 61 which are each designed to fit over a corresponding one of the projections 55 and 57 as more fully described below.

Preferably, a spring biased elongated bar member 76 is mounted in the channel 60 of half segment 56 adjacent one end thereof. The bar member 76 includes a plurality of teeth and a plurality of notches. A spring biased elongated pin member 78 is slidably mounted through the half segment 56. An end of the pin member is adapted to extend into the channel 60 when force is applied to the opposite end thereof against the restoring forces of the associated spring (not shown).

According to the first presently preferred embodiment, the supply of safety line 16 is preferably comprised of two intertwined lines 64 and 66. Each of the lines includes a diverging end portion 68 and 70, respectively. Each of the diverging end portions preferably terminates in a knot 82 and 84.

A bar member 80 is preferably secured to the intertwined lines 64 and 66. Bar member 80 includes a plurality of teeth and a plurality of notches. The teeth of bar member 80 are adapted to engage the notches in spring biased bar member 76 as more fully described below.

The intertwined lines 64 and 66 are partially positioned in channel 60 of half segment 56 as shown in FIG. 4. Each diverging end portion, 68 and 70, is preferably formed into a loop so that it can extend outwardly from the half segment 56. Each knot, 82 and 84 is positioned by corresponding recessed portion 63 and 65 provided in one or both of half segments 56, 58 thereby capturing the knots 82, 84 within and affixing the knots to the rescue device 14 in substantially tamper-resistant and environmentally protected fashion. The half segment 58 is positioned on top of half segment 56 so that the Y-shaped channels, 60 and 62, in each of the segments overlie one another to define a Y-shaped passageway. The two half segments are preferably secured to one another by two screws 90 and 92 which are each positioned through a corresponding screw hole 59 and 61 in half segment 58, and threaded into a threaded opening in a corresponding projection 55 and 57. It should be noted, however, that the two half segments can be releasably or permanently secured to one another by a variety of conventional means.

Each loop defines an opening. The openings, defined by the loops, can be enlarged or reduced by either pushing the intertwined lines 64 and 66 into the rescue device 14 or by pulling the lines outwardly therefrom.

In order to facilitate an understanding of the principles associated with the foregoing apparatus, its operation will now be briefly described in connection with a water rescue operation. It will be appreciated, however, that the following discussion is equally applicable to the manner by which apparatus 10 may be deployed to conduct a rescue on land. A user grasps gripping member 33 and pulls the same in order to extend spring 40 a predetermined amount and dispose the spring into a predetermined loaded or stressed condition. More specifically, the further the person to be rescued is from the rescuer, the further the spring must be extended so that the restoring force is sufficient enough to propel the floatation device the requisite distance. As the gripping member 33 is pulled back, the teeth 34, which extend from ratchet 30, contact the pawl 35. The pawl is inserted into and engages one of the notches 32 between adjacent teeth 34 to restrict movement of the ratchet 30 as the same is pulled back and sufficiently extended.

Thereafter, the rescue device 14 is positioned atop the firearm 12 in such a manner that the rescue device engaging segment 38 engages a notch or similar formation in rescue device 14. The user then pulls back on the trigger 24 in order to urge the pawl 35 to pivot about pin 36 and move out of the selected notch 32 in the ratchet 30. The restoring force of the spring 40 causes the ratchet 30 and rescue device engaging segment 38, which is connected thereto, to move axially along the length of the barrel 20 of the firearm 12. Once the rescue device engaging segment 38 reaches the muzzle 26 of the barrel it is immediately brought to a halt, thereby causing the rescue device, and the supply of safety line attached thereto, to be propelled toward the person in distress.

The victim then grasps the rescue device 14 and preferably inserts one or both of his or her hands through the loops formed by the diverging end portions 68 and 70 of the lines 64 and 66. The victim then signals the rescuer to pull him or her ashore. As the victim is pulled in, the openings, defined by each of the loops, are tightened around the wrists of the victim. The loops are locked in place when the teeth in the bar member 80 engage the notches in the spring biased bar member 76 to prevent over-tightening of the loops about the victim's wrists. After the victim is pulled to safety, his or her wrists are freed by pressing the spring loaded pin member 78 so that a portion of the intertwined lines is forced against the spring biased bar member 76 and the same is detracted thereby causing the teeth of bar member 80 to be disengaged from the notches in spring biased bar member 76. This allows the intertwined lines 64 and 66 to be pushed inwardly so that the opening in the loops can be enlarged thereby enabling withdrawal of the victim's hands therefrom.

Figure 6:
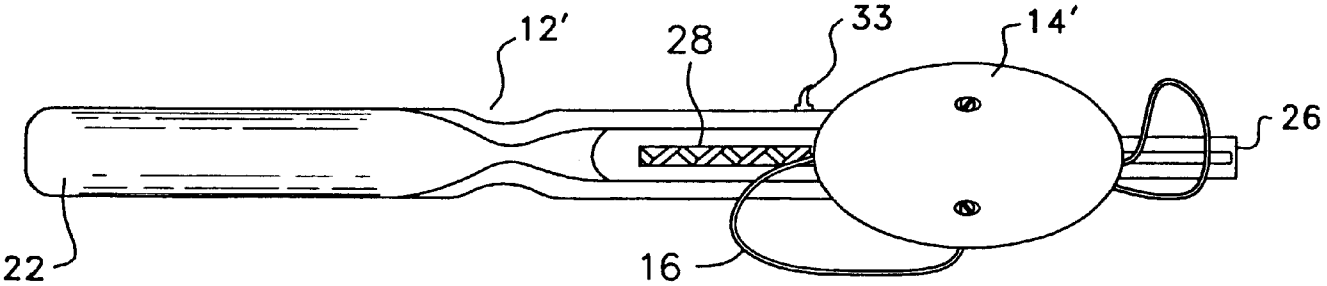
FIG. 6 is a top plan view of the rescue apparatus of FIG. 5.
Figure 7:
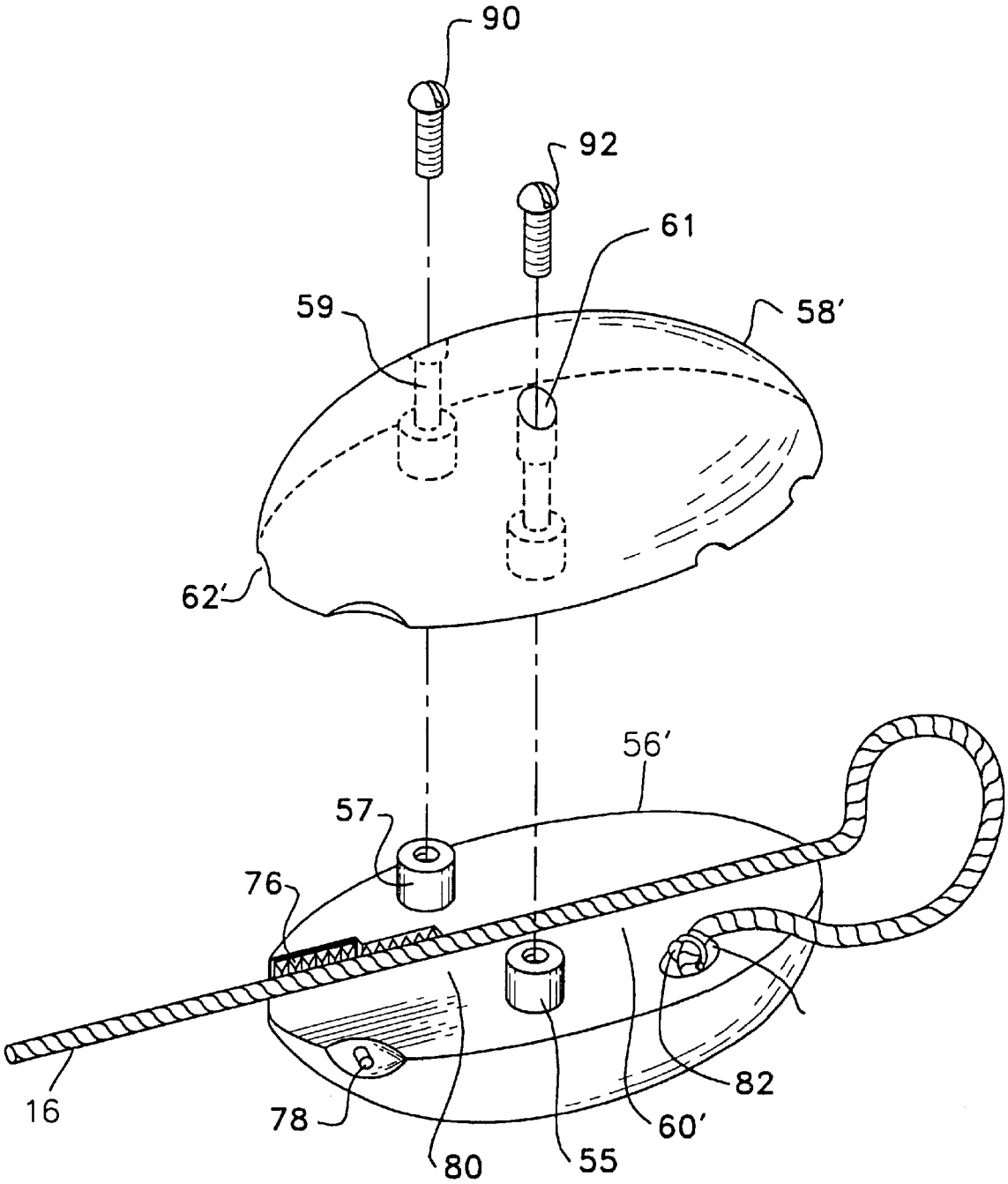
FIG. 7 is an exploded view similar to FIG. 4 of a further embodiment of a rescue device according to the present invention.

FIGS. 5, 6, and 7 illustrate further embodiments of a rescue apparatus and rescue device in accordance with the present invention. For brevity, except where necessary for a proper and thorough depiction of the present invention, only those features of rescue apparatus 10', firearm 12' rescue device 14' which depart in structure and/or function to their counterparts in the earlier drawing figures will be described in detail with regard to FIGS. 5–7.

Rather than the tension spring 40 utilized in firearm 12, firearm 12' of FIGS. 5 and 6 are desirably provided with a compression spring 40' as the source of motive energy for launching rescue device 14' toward a person in distress. One end of spring 40' is secured to ratchet 30 and the opposite and is secured to the shoulder stock end of the barrel. Loading or stressing of spring 40' is achieved by pulling rearwardly or gripping member 33 to compress the spring 40 whereby the pawl becomes in engaged in one of the plurality of notches 32 (FIG. 3) in ratchet 30. Desirably, the spring 40' is compressed sufficiently to enable the spring when released, to propel the rescue device 14' (or line 18) to within reaching distance of the victim.

Referring to FIG. 7, there is shown a presently preferred construction of rescue device 14', which like rescue device 14, is preferably aerodynamic and, if used for water rescues, buoyant. Rescue device 14' comprises a body preferably including first and second half segments 56' and 58' which are substantially similar to half segments 56, 58 of rescue device 14. Half segments 56' and 58' respectively include matable safety line accommodating channels 60' and 62'. When the half segments 56', 58' are positioned in facing relation and secured to one another (e.g., by screws 90, 92) the opposed channels 62', 64' establish a single passageway through which the safety line 16 may slide. Such a construction minimizes the number of passageways through which the line 16 slides and, correspondingly, reduces the likelihood of malfunction of the rescue device under rescue conditions.

Line 16 preferably terminates in a knot 82 which is adapted for positioning in a recessed portion 83 of half segment 56'. When the knot 82 is received in recessed portion 83 and the half segments 56', 58' are joined to one another, a single slip-loop is formed through which a victim may insert his or her wrists or other body part to execute the rescue operation described above. And, when fully assembled, rescue devices 14 and 14' disclosed herein provide reliable slip-loop rescue devices wherein the terminus of the rescue line is affixed to the rescue device and, preferably, protected from the elements.

Although the invention has been described in detail for the purpose of illustration, it is to be understood that such detail is solely for that purpose and that variations can be made thereof by those skilled in the art without departing from the scope of the invention except as it may be limited by the claims.

What is claimed is:

1. A rescue apparatus comprising;

a spring loaded firearm including a barrel, a shoulder stock and a trigger means;

a spring situated within said barrel and extending along the length thereof, said spring having two opposing ends;

a rescue device;

a supply of safety line having first and second ends, said first end being secured to said spring loaded firearm, said second end being secured to said device;

securing means being secured to one end of said spring; said securing means being adapted to releasably secure said device to said one end of said spring, and locking means associated with said trigger means for releasably locking said spring in a loaded position against the restoring forces of the same so that when said trigger means is depressed said restoring forces of said spring causes device to rapidly move along the length of said barrel and be propelled into the air carrying said second end of said supply of safety line therewith.

2. The apparatus of claim 1 wherein said barrel has an elongated groove extending along the length thereof and said device includes a notch formed in the bottom thereof, said securing means extending upwardly through said elongated groove in said barrel and being adapted to releasably engage said device.

3. The apparatus of claim 1 wherein said locking means comprises a ratchet and a pawl, said ratchet including a plurality of teeth and a plurality of notches, each of said notches being located adjacent two of said teeth, said pawl extending from said trigger means, said pawl adapted to move from a first position, wherein said pawl extends into one of said notches and frictionally engages one of said teeth, to a second position, wherein said pawl is positioned out of said notch.

4. The apparatus of claim 1 further including an elongated container secured to said barrel, said container having said first end of said supply of line secured therein and said second end of said supply line extending outwardly therefrom.

5. The apparatus of claim 1 wherein said rescue device comprises:

a body;

at least one passageway in said body operable to slidably receive said safety line;

said safety line being partially positioned within said at least one passageway, said safety line being formed into at least one loop extending outwardly from said device to define at least one opening and terminating in at least one end secured to said device; and means for enlarging and reducing the size of said opening in each of said at least one loop.

6. A rescue device comprising:

a first segment having a planar surface and an arcuate surface;

a second segment having a planar surface and an arcuate surface;

said first and second segments each having a channel located in said planar surfaces thereof, said channels in each of said segments being adapted to overlie one another to define a passageway;

means for securing said first and second segments to one another;

a safety line partially and slidably positioned within said passageway, said safety line being formed into at least one loop extending outwardly from said device to define at least one loop and terminating in at least one end fixedly secured to said device.

7. The device of claim 6 further comprising means for enlarging and reducing the diameter of said opening in each of said at least one loop.

8. The device of claim 7 wherein said device is a buoyant floatation device.

9. The device of claim 8 wherein said floatation device is comprised of a rigid polymeric material.

10. The device of claim 8 wherein said floatation device is substantially football-shaped.

11. The device of claim 6 further including locking means for locking said at least one loop in a fixed position.

12. The rescue device of claim 11 wherein said locking means includes:

a fixed bar member secured to said safety line, said fixed bar member including a plurality of teeth and a plurality of notches, and a spring biased bar member mounted in said device, said spring biased bar member including a plurality of teeth and a plurality of notches, each of said notches positioned adjacent two of said teeth;

said teeth in said fixed bar member being adapted to engage said notches in said spring biased bar member.

* * * * *